US005704096A

United States Patent [19]

Lang

[11] Patent Number: 5,704,096

[45] Date of Patent: Jan. 6, 1998

[54] DRAFTING ARRANGEMENT FOR SPINNING MACHINES

[75] Inventor: Kurt Lang, Lauterstein, Germany

[73] Assignees: Fritz Stahlecker, Bad Ueberkingen; Hans Stahlecker, Suessen, both of Germany

[21] Appl. No.: 708,602

[22] Filed: Sep. 5, 1996

[30] Foreign Application Priority Data

Oct. 7, 1995 [DE] Germany ..... 195 37 470.3

[51] Int. Cl.[6] ..... D01H 5/72

[52] U.S. Cl. ..... 19/288; 19/291

[58] Field of Search ..... 19/236, 246, 287, 19/288, 289, 290, 291, 292, 239, 240, 23, 150

[56] References Cited

U.S. PATENT DOCUMENTS

| | | | |
|---|---|---|---|
| 2,187,830 | 1/1940 | Jones | 19/287 |
| 2,498,364 | 2/1950 | Fraser | 19/246 |
| 2,840,860 | 7/1958 | Raper | 19/288 |
| 4,485,528 | 12/1984 | Anahara et al. | 19/288 |
| 4,949,431 | 8/1990 | Gasser | 19/150 |
| 5,018,246 | 5/1991 | Leifeld | 19/150 |
| 5,379,488 | 1/1995 | Stahlecker | 19/287 |
| 5,461,757 | 10/1995 | Leifeld | 19/239 |
| 5,501,100 | 3/1996 | Baechler et al. | 19/239 |

FOREIGN PATENT DOCUMENTS

| | | |
|---|---|---|
| 1250315 | 9/1967 | Germany . |
| 4039802A1 | 6/1992 | Germany . |
| 4227492A1 | 2/1994 | Germany . |

*Primary Examiner*—Michael A. Neas

*Attorney, Agent, or Firm*—Evenson, McKeown, Edwards & Lenahan, P.L.L.C.

[57] ABSTRACT

In the case of a drafting arrangement for a spinning machine, at least one drafting zone has a sliver guide with a guiding surface for the travelling sliver. The sliver guide is arranged in a wedge-shaped gap, which is formed by a roller pair downstream of the drafting zone. According to the present invention, the sliver guide comprises a sliver brake with a pressing element which slides on the sliver. The pressing element is resilient with a pressure in the direction towards the guiding surface, and is disposable against the travelling sliver. The evenness of the drafting is thereby improved.

25 Claims, 4 Drawing Sheets

DRAFTING ARRANGEMENT FOR SPINNING MACHINES

BACKGROUND AND SUMMARY OF THE INVENTION

The present invention relates to a drafting arrangement for spinning machines comprising at least three roller pairs which form drafting zones one behind the other in travelling direction of a sliver, of which roller pairs at least one comprises a sliver guide which is arranged inside of the wedge-shaped gap of the roller pair downstream of the relevant drafting zone.

From U.S. Pat. No. 5,379,488 a drafting arrangement with sliver guides is known, each of which is arranged upstream of a roller pair. The sliver guides are in the form of sliver condensers, which condense the diameter of the sliver and lead it through the wedge-shaped gaps to the roller pairs positioned thereat. They guide the sliver without any significant friction and do not exercise any retarding force on the fibers. In the main drafting zone, travelling aprons are arranged which guide the sliver and, by means of the retarding forces effected by the aprons, make the drafting more even. In the other drafting zone, components for evening the drafting are not present.

It is an object of the present invention, to even the drafting of the sliver.

This object has been achieved in accordance with the present invention in that the sliver guide comprises a sliver brake in the area of the wedge-shaped gap, which sliver brake comprises a pressing element which slides on the sliver, which pressing element is resilient with a pressure in the direction towards the guiding surface and which is disposable against the travelling sliver.

The sliver guide according to the present invention is arranged in close proximity to the roller pair downstream of the drafting zone and forms a slip draft area extending towards the nipping line of the roller pair. The sliver is nipped between the guiding surface and the pressing element, whereby under friction, it slides along on the guiding surface and the pressing element. A certain pressure is given by the resiliently arranged pressing element. The friction is stronger the greater the pressure. As a result of the friction, the fibers, which are not yet caught in the nipping line, are held back and are not taken along in packets.

The sliver brake is particularly suitable for drafting arrangements which operate with very high drafts, as is the case for example in ring spinning machines, which spin slivers fed from cans directly into yarn. Such slivers do not have a twist, in contrast to speed frame rovings, which are fed to standard ring spinning machines.

It is contemplated to have the sliver brakes in a drafting zone in addition to driven aprons. In this case, the sliver brake is preferably arranged downstream of the aprons in travelling direction of the sliver. The sliver brake according to the present invention is frequently sufficient to ensure the evenness of the drafting. It is therefore particularly advantageous to arrange the sliver brake in a drafting zone where normally there are no aprons present.

It is contemplated in the case of the sliver guide to provide supporting surfaces beside the pressing element for lateral guiding of the sliver.

The guiding surface and the pressing element can be arranged advantageously in such a way that the pressure in travelling direction of the sliver is effective in the front area of the guiding surface.

The necessary pressure can be predetermined by an appropriate construction of the pressing element. It is hereby advantageous to provide a device for the pressing element for adjusting the pressure.

There are various possibilities for effecting pressure from the pressing element. It is, for example, advantageously possible to create the necessary pressure by means of magnets or by means of the dead weight of the pressing element itself.

In an advantageous embodiment of the present invention the pressure is generated by means of a spring, which can for example be disposed against the pressing element.

In an advantageous embodiment of the present invention, the pressing element is formed by a leaf spring.

In an advantageous embodiment of the present invention, the sliver brake comprises two pressing elements disposed opposite each other, with opposing pressures against one another, of which at least one pressing element comprises a guiding surface. It is hereby advantageously possible to use a leaf spring for each pressing element, which leaf springs are disposed essentially parallel to each other at their front end sections which face the wedge-shaped gap, and comprising guiding surfaces facing each other which are resilient in relation to the drafting plane.

In an advantageous embodiment of the present invention, the sliver brake is arranged at a sliver condenser, which sliver condenser comprises a wall containing the guiding surface and also a slit at a distance from said wall, which slit is at least partly coverable by the pressing element. The width of the slit can be adapted to suit the technical spinning requirements; for example, it can essentially correspond to the width of the guiding surface.

In an advantageous embodiment of the present invention, the position of the sliver brake in the travelling direction of the sliver is adjustable. Thus the best setting, depending on the spinning conditions, for an evenness of the draft can hereby be maintained. It is possible to push the sliver brake very far into the wedge-shaped gap, whereby the sliver guide can even rest slightly on the bottom roller.

In an advantageous embodiment of the present invention, the sliver brake is supported by a holder traversing in axial direction of the roller pairs.

In an advantageous embodiment of the present invention, the sliver brakes of two adjacent drafting arrangements are supported on the same joining piece. The pressing elements of two adjacent drafting arrangements can hereby be advantageously supported on a common joining piece. A leaf spring made in one piece can then be used, which combines the pressing elements for both drafting arrangements as well as the joining piece therein.

In a further advantageous embodiment of the present invention, the sliver brake and the sliver condenser are supported by a common holder.

Other objects, advantages and novel features of the present invention will become apparent from the following detailed description of the invention when considered in conjunction with the accompanying drawings.

DETAILED DESCRIPTION OF THE DRAWINGS

Figure 1:
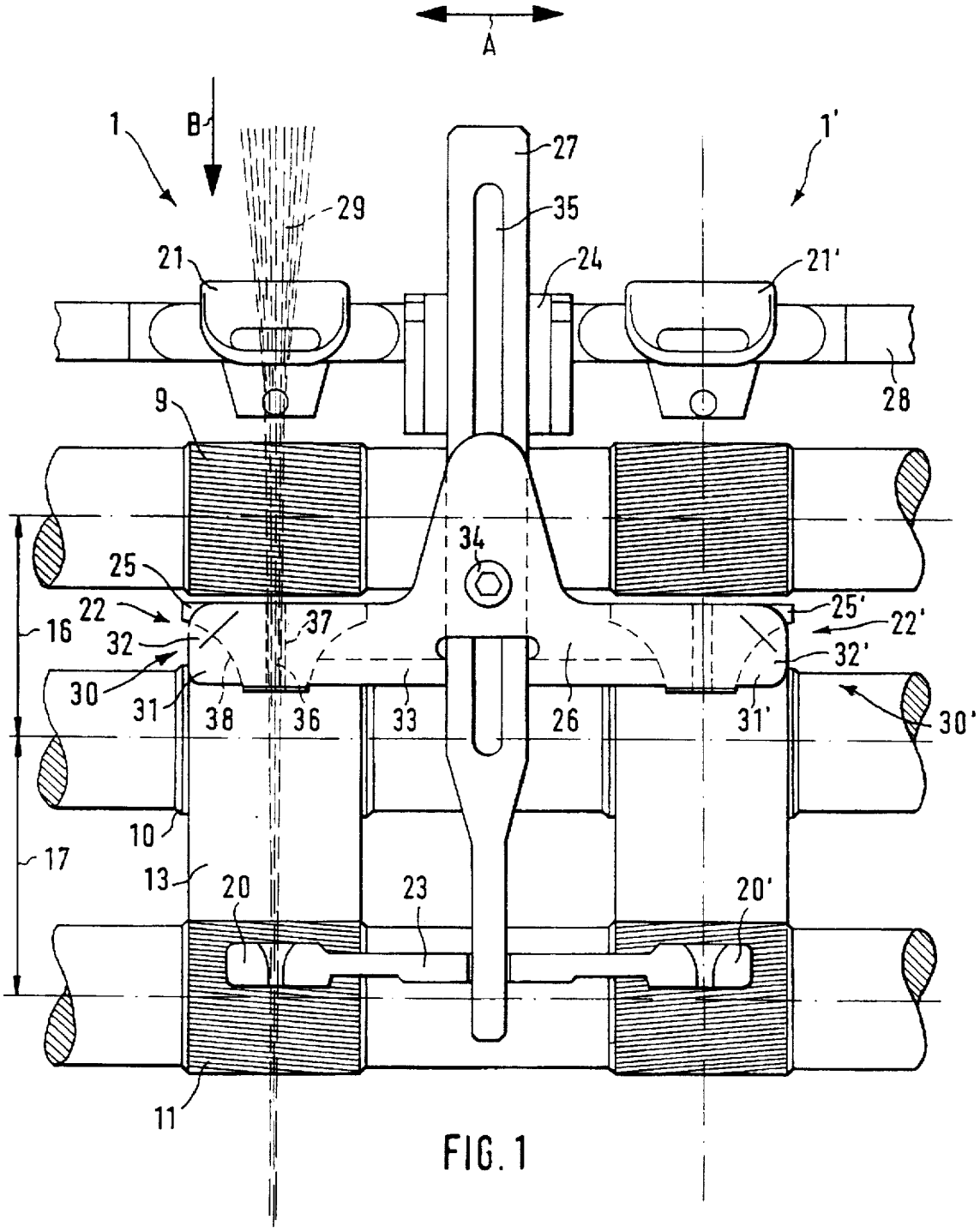
FIG. 1 is a schematic representation of a drafting arrangement of a ring spinning machine in a top view with a first embodiment of a friction brake, whereby the top rollers of the drafting arrangement are not shown.
Figure 2:
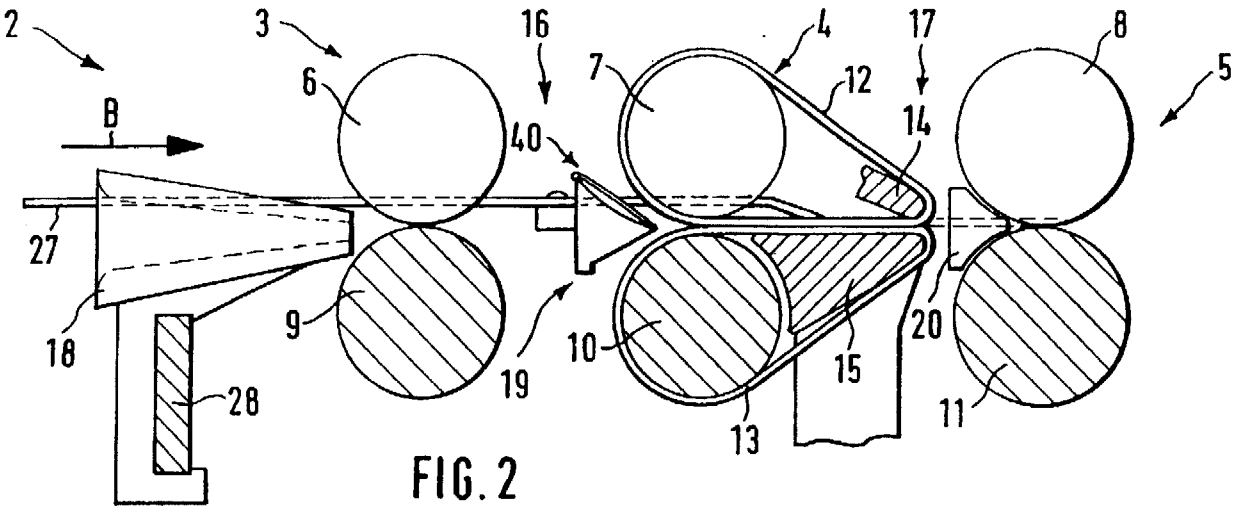
FIG. 2 is a schematic sectional side view of the drafting arrangement of FIG. 1 in a slightly changed form with a second embodiment of a friction brake.

The drafting arrangement 1 shown in FIG. 1 is joined with an adjacent, similarly constructed drafting arrangement 1' to form a twin drafting arrangement in a ring spinning machine (not shown). The drafting arrangement 2 shown in FIG. 2 is essentially similar in construction to the drafting arrangement 1 in FIG. 1. For the purpose of clarity, the drafting arrangement 2 of FIG. 2 will be described first, followed by the drafting arrangement 1 and 1'. The description applies to the drafting arrangement 2 as well as to the drafting arrangement 1 and 1', insofar as reference is not made to deviations.

As can be seen from FIG. 2, the drafting arrangement 2 comprises three roller pairs 3,4,5 each with a top roller 6,7,8 and a bottom roller 9,10,11. There is an apron guide with an apron 12 and an apron 13 arranged thereto between the middle roller pair 4 and the front roller pair 5. The apron 12 is looped around the top roller 7 and is guided over a guiding rail 14. In a corresponding way, the apron 13 is looped around the bottom roller 10 and is guided over a guiding rail 15.

Between the roller pairs 3 and 4, a drafting zone 16, usually denoted as a pre-drafting zone, is formed, while between the roller pairs 4 and 5, a drafting zone 17, usually denoted as a main drafting zone is formed. The length of the drafting zones 16 and 17 can be adjusted by sliding the roller pairs 3 and 4.

A sliver guide 18,19,20 is arranged in arrow direction B upstream of each roller pair 3,4,5. In the case of the drafting arrangement 1 shown in FIG. 1, instead of the sliver guide 18, a slightly altered sliver guide 21 is provided, and instead of the sliver guide 19, a slightly altered sliver guide 22 is provided.

As can be seen from FIG. 1, the sliver guides 20,21 take the form of sliver condensers or sliver funnels and are joined in one structural member by means of joining pieces 23,24 with adjacent sliver guides 20',21'. The sliver guide 22 comprises a sliver condenser 25, which is joined by a joining piece 25' in a corresponding way. The joining pieces 23,24, 26 are connected to a holder 27 extending in arrow direction B, which holder 27 is secured to a traversing rail 28 which traverses in arrow direction A.

During spinning, a sliver 29 is fed to the drafting arrangement 1, which sliver lies in a can (not shown) in the form of a drawing frame sliver without twist. The drafting arrangement 1 is operated as a high draft drafting arrangement, that is, the bottom roller 9 operates at a very low speed and the bottom roller 11 at a very high speed. The sliver 29 is guided through the sliver guides 21,22,20 in travel direction B and is drafted in the drafting zones 16 and 17. It is hereby traversed slowly in arrow direction A.

The sliver guide 22 comprises in addition to the above mentioned sliver condenser 25 a sliver brake 30. The sliver brake 30 comprises a pressing element 31, which takes the form of a leaf spring 32 and which operates in conjunction with the sliver condenser 25. The leaf spring 32 of the drafting arrangement 1 is joined to form one structural member with a leaf spring 32' of the adjacent drafting arrangement 1' by means of a joining piece 33, whereby the leaf springs 32 and 32', together with the joining piece 33, form a T-shaped wing spring. The joining piece 33 is fastened with a fastening screw 34 together with the joining piece 26 of the sliver condensers 25,25' at a longitudinal slit 35 of the traversing holder 27. Thus the sliver guide 22 with the sliver brake 30 and with the sliver condenser 25 and an adjacent sliver guide 22' with an adjacent sliver brake 30' and the adjacent sliver condenser 25' are all supported on the joining piece 26 and fastened to the holder 27. The longitudinal slit 35 enables the sliver guide 22 with the sliver brake 30 to be adjusted in travelling direction B of the sliver 29 and be set into a desired position.

The sliver condenser 25 has the form of a funnel tapering in travelling direction B of the sliver 29. It has on one wall a lower guiding surface 36 for the sliver 29, opposite which guiding surface 36 a continuous slit 37 is disposed in direction B. Side walls (not shown) adjoin the guiding surface 36, which side walls support the sliver 29 laterally. The pressing element 31 covers almost the entire upper side of the sliver condenser 25 including the slit 37, and is arranged resiliently in the direction towards the guiding surface 36, whereby a predetermined pressure in the direction towards the guiding surface 36 becomes effective. The pressing element 31 in the embodiment in FIG. 1 is formed and arranged in such a way that the pressure is effective above all at the exit end of the sliver guide 22, that is at the end facing the bottom roller 10.

The pressing element 31 is disposed with a pressure of preset value in the area of the slit 37 on the sliver 29 which is moved in travelling direction B and presses the sliver 29 in the direction towards the guiding surface 36. The sliver 29 slides along the pressing element 31 and the guiding surface 36, whereby a frictional force is acted on the sliver 29. The sliding friction results in a slip area being formed between the sliver brake 30 and the nipping line of the roller pair 4, in which slip area the fibers of the sliver 29, which have not yet reached the nipping line, are held back. Because the pulling-along of floating fibers is prevented, the draft in the drafting zone 16 is evened out.

The sliver condenser 25 is provided on its outer side with a recess 38. The leaf spring 32 can be raised slightly in the area of the recess 38, in order to guide the sliver 29 through the slit 37 into the sliver condenser 25.

The sliver guide 19 shown in FIG. 2 differs from the sliver guide 22 in FIG. 1 mainly in that it comprises a second embodiment of a sliver brake 40. In a corresponding way to the sliver guide 22 of FIG. 1, the sliver guide 19 is connected together with an adjacent sliver guide (not shown in FIG. 2) to the traversing holder 27.

Figure 4:
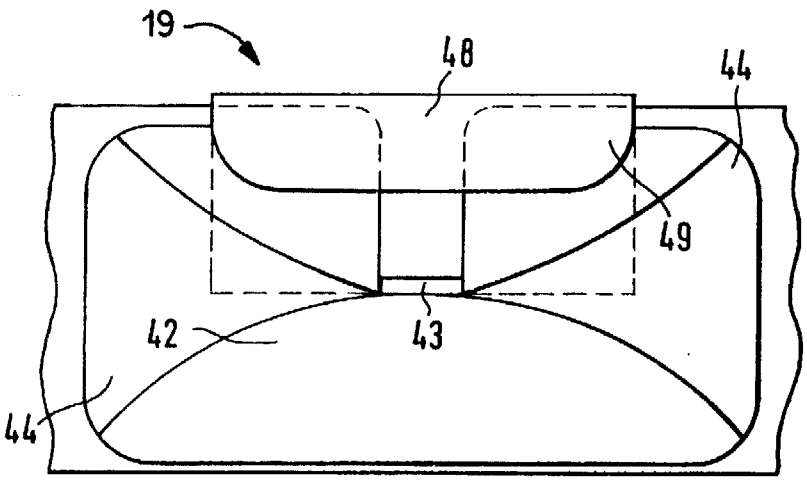
FIG. 4 is a view of the friction brake of FIG. 3 in arrow direction IV of FIG. 3.
Figure 3:
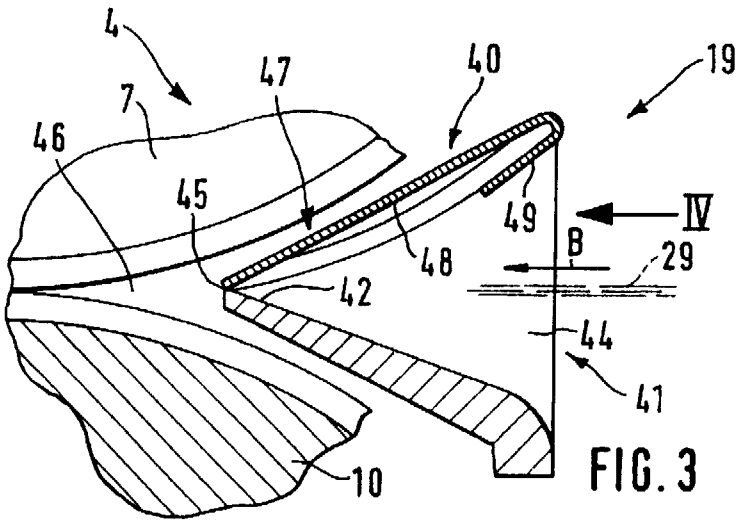
FIG. 3 is an enlarged longitudinal section through the friction brake of FIG. 2 in reverse view.

As can be seen from FIGS. 3 and 4, the sliver guide 19 comprises a sliver condenser 25 in addition to the above mentioned sliver brake 40. The sliver condenser 41 is identical to the sliver condenser 30 of FIG. 1. In FIG. 3 in particular it can be seen that the sliver condenser 41 has the form of a funnel tapering in travelling direction B of the sliver 29; it also has a guiding surface 42, a slit 43 disposed opposite thereto and two side walls 44 adjoining the guiding surface 42. The sliver guide 19 projects with its outgoing end 45 into a wedge-shaped gap formed by the top roller 7 and the bottom roller 10.

The sliver brake 40 comprises a pressing element 47, which is in the form of a leaf spring 48 and which covers the slit 43. The leaf spring 48 operates in conjunction with the sliver condenser 41 in the same way as the leaf spring 32 of FIG. 1 with the sliver condenser 25. The leaf spring 48 is thus arranged resiliently in the direction towards the guiding surface 42, whereby a predetermined pressure becomes effective in the direction towards the guiding surface 42. The pressure is effective above all in the area of the outgoing end 45 of the sliver guide 19, that is, at the end facing the nipping line 46.

The leaf spring 46 differs from the leaf spring 32 of FIG. 1 mainly in that it is secured to the sliver condenser 41 individually. The leaf spring 48 has a clip edge folded over at 180°, with which it is clipped onto the sliver condenser 41 in the area of its in-going end.

Figure 5:
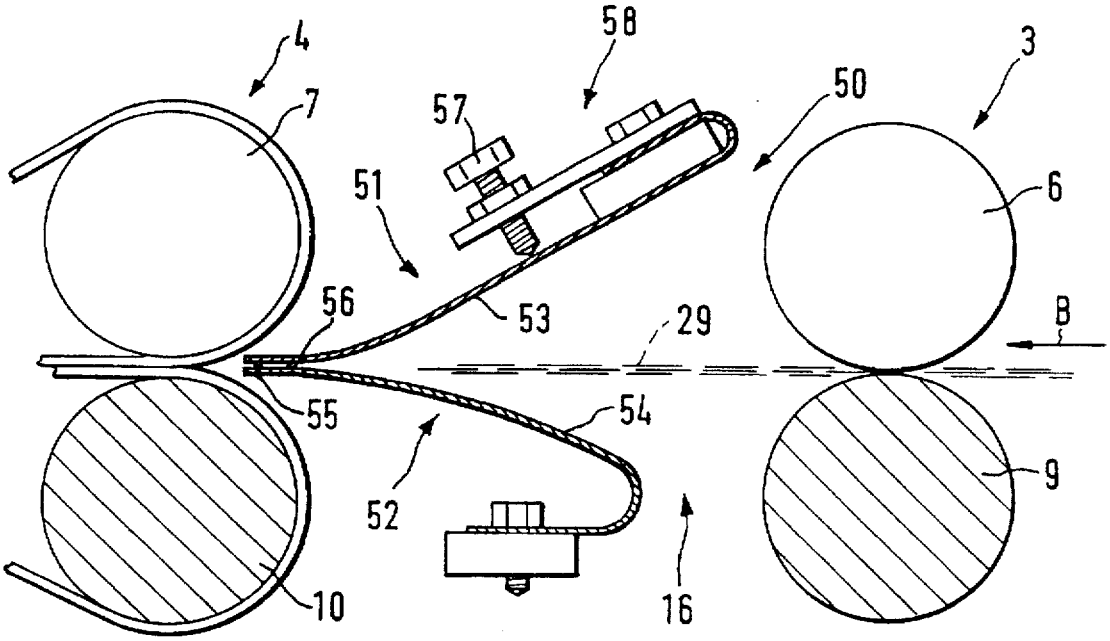
FIG. 5 is a schematic sectional side view of a third embodiment of a friction brake.

The third embodiment of a sliver brake 50 shown in FIG. 5 comprises two pressing elements 51 and 52 disposed opposite one another, each of which take the form of a leaf spring 53 and 54. The pressing element 51 is secured to a top weighting arm of the drafting arrangement, which arm supports the top rollers 6,7, and the pressing element 52 is secured to a supporting part of the drafting arrangement in the area of the bottom rollers 9,10. Each leaf spring 53 and 54 comprises a guiding surface 55 and 56, which are arranged disposed opposite each other and essentially parallel to one another. Both guiding surfaces 55 and 56 rest with a predetermined pressure, which comes from the pressing elements 51 and 52, against the sliver 29 which moves in running direction B.

The pressure exercised by the pressing element 51 can be regulated by means of an adjusting screw 57. The guiding surfaces 55,56 and the sliver 29 guided thereby can also reach an area outside of the draft plane formed between the roller pairs 3 and 4. Both pressing elements 51 and 52 form together a sliver guide 58, where a sliver condenser or lateral supports are not present.

Figure 6:
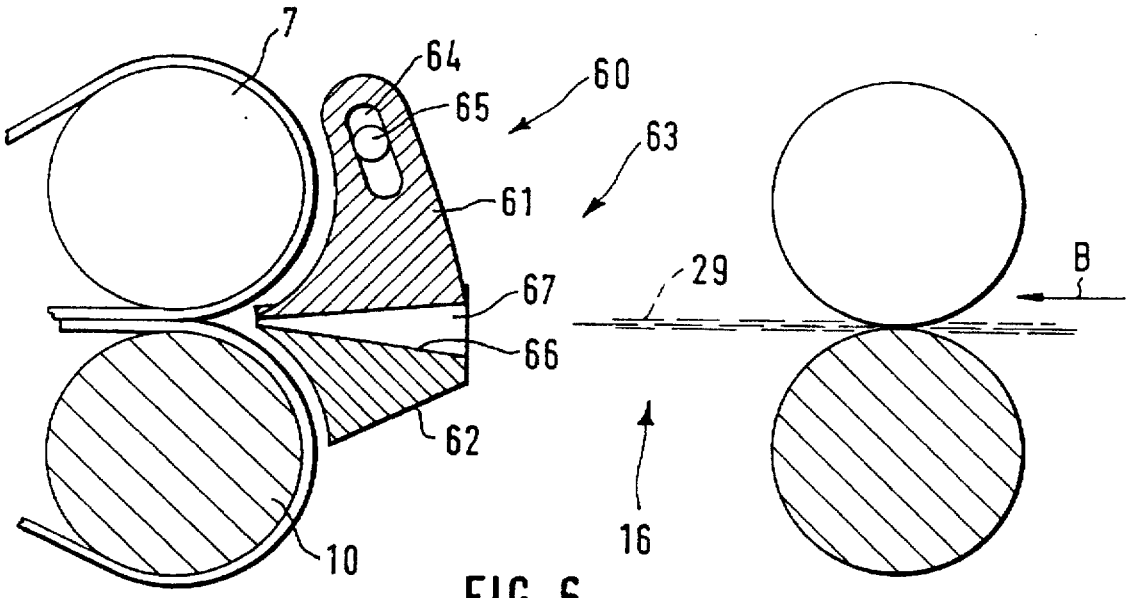
FIG. 6 is a schematic sectional side view of a fourth embodiment of a friction brake.

The fourth embodiment of a sliver brake 60 shown in FIG. 6 comprises a pressing element 61, which is positioned at a sliver condenser 62 and which together therewith forms a sliver guide 63. The pressing element 61 is provided with a guiding groove 64, into which a stationary guiding pin 65 projects, which can, for example, be secured to a top weighting arm for the top rollers 6,7,8 (see also FIG. 2). The sliver condenser 62 has a guiding surface 66 and two side walls 67 laterally adjoined thereto. The sliver condenser 62 forms a channel open at the top and tapering in the travelling direction B of the sliver 29, in which channel the pressing element 61 is slidably inserted at its lower section in an at least approximately vertical position. The pressing element 61 is guided by the combined action of the guiding pin 65 together with the guiding groove 64 and by the lateral walls 67.

The desired pressure is created by the dead weight of the pressing element 61 itself. The pressing element 61 can be weighted with additional weights (not shown) to increase the pressure.

Figure 7:
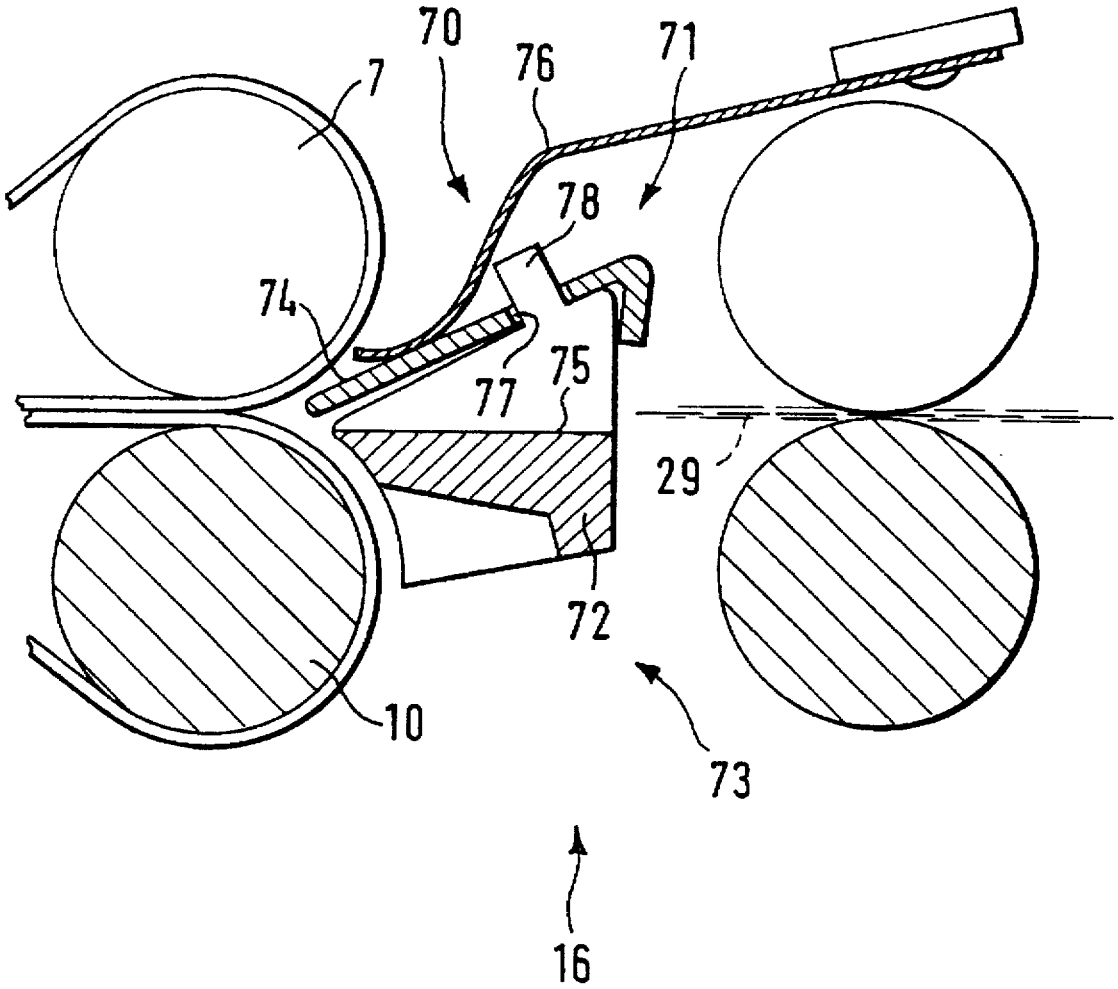
FIG. 7 is a schematic sectional side view of a fifth embodiment of a friction brake.

The fifth embodiment of a sliver brake 70 shown in FIG. 7 comprises a pressing element 71, which is positioned at a sliver condenser 72 and which together with the sliver condenser 72 forms a sliver guide 73. The pressing element 71 comprises a flap 74, which is weighted with pressure in the direction towards a guiding surface 75 of the sliver condenser 72. The pressure is generated by a spring 76, which is disposed against the flap 74. The flap 74, which is movable at least approximately vertically, has an opening 77, into which a lifter of the sliver condenser 72 projects with clearance. The spring-weighted flap 74 can hereby be guided laterally.

The sliver condenser 72 is to great extent identical with the sliver condensers 25,41 shown in FIGS. 1 to 4. It has thus the form of a funnel tapering in travelling direction B of the sliver 29 and has two side walls (not shown) which laterally adjoin the guiding surface 75, and a slit opposite one of the guiding surfaces 75, which slit is covered by the flap 74.

Although the invention has been described and illustrated in detail, it is to be clearly understood that the same is by way of illustration and example, and is not to be taken by way of limitation. The spirit and scope of the present invention are to be limited only by the terms of the appended claims.

What is claimed is:

1. A drafting arrangement for spinning machines, comprising:

at least three roller pairs forming a plurality of drafting zones in the travelling direction of a sliver, each roller pair forming a wedge-shaped gap for the sliver, and a sliver guide in at least one of the drafting zones, said sliver guide being arranged inside the wedge-shaped gap at the downstream end of the relevant drafting zone, wherein the sliver guide comprises:

a guiding surface, and a sliver brake arranged at the wedge-shaped gap, said sliver brake including a pressing element which slides on the sliver, which is resilient with a pressure in the direction towards said guiding surface, and which is disposable against the travelling sliver, wherein the sliver brake comprises two opposing pressing elements, which are disposed with opposing pressures against each other, of which pressing elements at least one comprises a guiding surface.

2. A drafting arrangement according to claim 1, wherein the sliver brake is arranged in the pre-drafting zone.

3. A drafting arrangement according to claim 1, wherein the pressure is generated by a spring.

4. A drafting arrangement according to claim 2, wherein the pressure is generated by a spring.

5. A drafting arrangement according to claim 3, wherein the pressing element is formed by a leaf spring.

6. A drafting arrangement according to claim 4, wherein the pressing element is formed by a leaf spring.

7. A drafting arrangement according to claim 1, wherein the position of the sliver brake is adjustable in the travelling direction of the sliver.

8. A drafting arrangement according to claim 1, wherein the sliver brakes of two adjacent drafting arrangements are supported by the same joining piece.

9. A drafting arrangement according to claim 4, wherein the sliver brakes of two adjacent drafting arrangements are supported by the same joining piece.

10. A drafting arrangement for spinning machine, comprising:

at least three roller pairs forming a plurality of drafting zones in the travelling direction of a sliver, each roller pair forming a wedge-shaped gap for the sliver, and a sliver guide in at least one of the drafting zones, said sliver guide being arranged inside the wedge-shaped gap at the downstream end of the relevant drafting zone, wherein the sliver guide comprises:

a guiding surface, and a sliver brake arranged at the wedge-shaped gap, said sliver brake including a pressing element which slides on the sliver which is resilient with a pressure in the direction towards said guiding surface, and which is disposable against the travelling sliver, wherein the sliver brake is positioned at a sliver condenser, which comprises a wall containing the guiding surface and a slit disposed opposite at a distance therefrom, which slit is at least partly covered by the pressing element.

11. A drafting arrangement according to claim 10, wherein the position of the sliver brake is adjustable in the travelling direction of the sliver.

12. A drafting arrangement according to claim 10, wherein the sliver brake is supported on a holder which traverses in an axial direction of the roller pairs.

13. A drafting arrangement according to claim 10, wherein the sliver brakes of two adjacent drafting arrangements are supported by the same joining piece.

14. A drafting arrangement according to claim 10, wherein the sliver brake and the sliver condenser are supported by the same holder.

15. A drafting arrangement according to claim 10, wherein the sliver brake is arranged in the pre-drafting zone.

16. A drafting arrangement according to claim 15, wherein the pressure is generated by a spring.

17. A drafting arrangement according to claim 10, wherein the pressure is generated by a spring.

18. A drafting arrangement according to claim 17, wherein the pressing element is formed by a leaf spring.

19. A drafting arrangement for spinning machines, comprising:

at least three roller pairs forming plurality of drafting zones in the travelling direction of a sliver, each roller pair forming a wedge-shaped gap for the sliver, and a sliver guide in at least one of the drafting zones, said sliver guide being arranged inside the wedge-shaped gap at the downstream end of the relevant drafting zone, wherein the sliver guide comprises:

a guiding surface, and a sliver brake arranged at the wedge-shaped gap, said sliver brake including a pressing element which slides on the sliver, which is resilient with a pressure in the direction towards said guiding surface, and which is disposable against the travelling sliver, wherein the sliver brake is supported on a holder secured to a traversing rail which traverses in an axial direction of the roller pairs.

20. A drafting arrangement according to claim 19, further comprising a sliver condensor, wherein the sliver brake and the sliver condenser are supported by the same holder.

21. A drafting arrangement according to claim 19, wherein the sliver brake is arranged in the pre-drafting zone.

22. A drafting arrangement for spinning machines, comprising:

at least three roller pairs forming a plurality of drafting zones in the travelling direction of a sliver, each roller pair forming a wedge-shaped gap for the sliver, and a sliver guide in at least one of the drafting zones, said sliver guide being arranged inside the wedge-shaped gap at the downstream end of the relevant drafting zone, wherein the sliver guide comprises:

a sliver condensor having a guiding surface, said sliver condensor having a funnel tapering shape in a travelling direction of the sliver, a sliver brake integrated into said sliver condensor and being arranged at the wedge-shaped gap, said sliver brake including a pressing element which slides on the sliver, which is resilient with a pressure in the direction towards said guiding surface, and which is disposable against the travelling sliver, and wherein at least a portion of one wall surface of said sliver condensor is loaded with a preset force in a direction of an opposite wall surface.

23. The drafting arrangement according to claim 22, wherein said portion of said one wall surface loaded with the preset force extends to an outlet opening of said sliver brake.

24. A drafting arrangement for spinning machines, comprising:

at least three roller pairs forming a plurality of drafting zones in the travelling direction of a sliver, each roller pair forming a wedge-shaped gap for the sliver, and a sliver guide in at least one of the drafting zones, said sliver guide being arranged inside the wedge-shaped gap at the downstream end of the relevant drafting zone, wherein the sliver guide comprises:

a guiding surface, and a sliver brake arranged in a pre-drafting zone in close proximity in front of the wedge shaped gap of one of said three roller pairs which limits said pre-drafting zone, said sliver brake including a pressing element which slides on the sliver, which is resilient with a pressure in the direction towards said guiding surface, and which is disposable against the travelling sliver.

25. A drafting arrangement for spinning machines, comprising:

at least three roller pairs forming a plurality of drafting zones in the travelling direction of a sliver, each roller pair forming a wedge-shaped gap for the sliver, and a sliver guide in at least one of the drafting zones, said sliver guide being arranged inside the wedge-shaped gap at the downstream end of the relevant drafting zone, wherein the sliver guide comprises:

a guiding surface, and a sliver brake arranged at the wedge-shaped gap, said sliver brake including a pressing element which slides on the sliver, which is resilient with a pressure in the direction towards said guiding surface, and which is disposable against the travelling sliver, and wherein said sliver brake arranged at the wedge-shaped gap is located immediately in front of one of said roller pairs which receives an upper apron and a lower apron of the apron guide.

* * * * *